US006874622B2

(12) United States Patent
Steegs et al.

(10) Patent No.: US 6,874,622 B2
(45) Date of Patent: Apr. 5, 2005

(54) METHOD OF PACKING A BATCH OF IMAGE-RECEIVING MATERIAL AND A BATCH OF IMAGE-RECEIVING MATERIAL ENCLOSED BY A CONTAINER

(75) Inventors: Wilhelmus L. J. Marie Steegs, Baarlo (NL); Johannes A. B. Van Der Laan, Venlo (NL); Laurentius F. P. Van Hagen, Kessel-Eik (NL)

(73) Assignee: Océ-Technologies B.V., Ma Venlo (NL)

( * ) Notice: Subject to any disclaimer, the term of this patent is extended or adjusted under 35 U.S.C. 154(b) by 0 days.

(21) Appl. No.: 10/101,372

(22) Filed: Mar. 20, 2002

(65) Prior Publication Data

US 2002/0157982 A1 Oct. 31, 2002

(30) Foreign Application Priority Data

Mar. 20, 2001 (NL) ..... 1017652

(51) Int. Cl.[7] ..... B65D 85/00
(52) U.S. Cl. ..... 206/215; 206/449
(58) Field of Search ..... 206/215, 449, 206/494, 812, 233, 209; 53/429, 117, 566, 475; 221/33, 45, 63

(56) References Cited

U.S. PATENT DOCUMENTS

| | | | | |
|---|---|---|---|---|
| 1,636,773 A | | 7/1927 | Greve | |
| 3,286,435 A | * | 11/1966 | Weinberger | 53/117 |
| 4,597,494 A | * | 7/1986 | Benoit | 206/390 |
| 5,368,188 A | * | 11/1994 | Twardowski | 221/50 |
| 5,810,200 A | * | 9/1998 | Trokhan | 221/55 |
| 5,882,767 A | * | 3/1999 | Simmons, Jr. | 428/126 |
| 5,918,735 A | * | 7/1999 | Bando et al. | 206/233 |
| 6,067,775 A | * | 5/2000 | O'Connor | 53/429 |
| 6,068,115 A | * | 5/2000 | Boulton | 206/232 |
| 6,092,690 A | * | 7/2000 | Bitowft et al. | 220/831 |
| 6,202,845 B1 | * | 3/2001 | Hill | 206/449 |
| 6,250,495 B1 | * | 6/2001 | Bando | 221/48 |
| 6,286,712 B1 | * | 9/2001 | Craig et al. | 221/48 |
| 6,550,634 B1 | * | 4/2003 | Alegre De Miquel et al. | 221/48 |

FOREIGN PATENT DOCUMENTS

| | | |
|---|---|---|
| EP | 0 609 002 A2 | 8/1994 |
| JP | 61-254430 A | 11/1986 |
| JP | 03-036122 A | 2/1991 |

* cited by examiner

*Primary Examiner*—Shian T. Luong
(74) *Attorney, Agent, or Firm*—Birch, Stewart, Kolasch & Birch, LLP

(57) ABSTRACT

A method of packing a batch of image-receiving material, more particularly paper or transparent plastic, in a container suitable for storing and transporting the batch, a number of stacked, substantially identical sheets of the image-receiving material, each sheet having a number of edges with the corresponding edges of the different sheets substantially coinciding with one another, wherein the batch is bent over a first bend and over a substantially identical second bend opposed to the first bend in such a manner that the batch assumes a substantially S-shaped configuration, and placing the batch in a container which encloses the bent batch so that the S-shaped configuration remains substantially in position for as long as the batch is in the container.

14 Claims, 2 Drawing Sheets

METHOD OF PACKING A BATCH OF IMAGE-RECEIVING MATERIAL AND A BATCH OF IMAGE-RECEIVING MATERIAL ENCLOSED BY A CONTAINER

BACKGROUND OF THE INVENTION

1. Field of the Invention

The present invention relates to a method of packing a batch of image-receiving material, more particularly paper or transparent plastic, in a container suitable for storing and transporting the material. The batch comprises a number of stacked, substantially identical sheets of the image-receiving material, each sheet having a number of edges, wherein the corresponding edges of the different sheets substantially coincide with one another. The present invention also relates to a batch of image-receiving material enclosed by a container.

2. Related Art

For storing and transporting purposes, it is known to pack in a stacked form image-receiving material, particularly paper and plastic film for use in a printer, copier or other image forming apparatus. In the known packaging systems, sheets of the image-receiving material are enclosed as a straight packet by a container, for example a cardboard box, the container being of the same shape as the stack of sheets. Thus, the inside dimensions of the container substantially correspond to the outside dimensions of the stack of image-receiving material. This method of packing has a number of significant disadvantages, particularly in the case of large formats of the sheets of receiving material, particularly the A1 format or larger. One very important disadvantage of this known method of packing is that there is a considerable risk of damage to the sheets of image-receiving material, not only while transporting the filled container but also during storage in storage accommodations. This is related to the fact that particularly with these large format image-receiving materials it is not possible to pack in a container stacks that are too high (i.e. too thick) because otherwise the weight of the container with the contents would be unacceptably heavy. It will be appreciated from the following that, as a result, the risk of damage to the sheets of image-receiving material is relatively considerable. On the one hand, large containers often extend out of the racks in storage accommodations so that they are easily damaged for example by fork lift trucks hitting the extended parts of the container. Next to that, large flat containers readily break open if they are incorrectly handled. During transportation, it has been found with these containers that the edges and particularly the corner points of the sheets are frequently damaged because a flat container of this kind readily and frequently distorts at its edges and corner points, for example because the container is dropped or collides with a solid wall (e.g. the walls of a van). Such damage can partly be obviated by making the container of a very rigid material, providing it with a double wall, reinforced corner points, a partial internal box, and the like. However, such containers are expensive to produce.

In addition to this disadvantage of damage, it is difficult to handle image-receiving materials packed in the known manner. Large flat containers are difficult to take hold of and lift. Another disadvantage of the known method of packing sheets of image-receiving material is that relatively considerable packing material is required. This not only increases the cost price of the packing but also means that the storage of the empty packages requires more space and there is considerable pollution to the environment because of the relatively large quantity of packing material required for one container.

A number of these problems can be obviated or at least reduced if a different method is used, which is known from the prior art. For example, it is known to roll up a batch of image-receiving material, particularly in the case of large formats, and pack it in a round container, for example a cardboard tube. This method of packing, however, also results in relatively considerable damage to the sheets. The reason for this is that the edges which are situated transversely to the roll-up direction are no longer straight as a result of the rolling up of the stack. Sheets at the outside of the rolled packet are of course bent over a larger diameter than sheets on the inside. The result of this fact that the sheets are no longer straight is that the outermost points of the rolled-up stack of sheets are extremely sensitive to damage. Even with this method of packing a relatively considerable number of the sheets becomes unusable due to transportation damage. In addition, it has been found that after a stack of paper, for example, has been unpacked and unrolled, the oblique edges of the stack remain in that position. Before a stack of this kind can be processed further, for example by placing it in a printer, the oblique edges must be straightened. This is frequently done by knocking the same, and this also entails a risk of damage, particularly to the outermost sheets. Another disadvantage of this method of packing is that it is not easy to handle round elongate containers. Palletising takes considerable time and often requires bundling with, for example, strapping, and this is again a disadvantage in the unloading of a pallet. Also, the round containers take up considerable space when stored as empty packing, because they cannot be folded flat. The round containers are also environmentally unfriendly, because the openings are frequently closed with plastic lids. These lids are frequently unsuitable for re-use because they are stapled to the edge of the container and are damaged when removed. Also, opening of a container of this kind entails inconvenience (removal of staples) and the existence of residual material (lids, staples, bulky containers). Finally, round containers are relatively expensive because they must be made from a relatively rigid material.

SUMMARY OF THE INVENTION

The object of the present invention is to provide a method of packing a stack of image-receiving material in a container suitable for storing and transporting which method obviates the above-described disadvantages and, in particular, provide a packing in which the sheets have much less risk of being damaged, is easy to handle, and also cheap to produce.

To this end, a method has been developed which comprises opening the container, bending the batch over a first bend and bending the batch over a substantially identical second bend opposed to the first bend, in such manner that the batch assumes a substantially S-shaped configuration, placing the batch in the container before or after bending and closing the container, wherein the container encloses the bent batch such that the S-shaped configuration remains substantially in position for long as the batch remains in the container.

A batch of image-receiving material has also been invented, wherein the batch is so bent that it comprises two substantially identical bends opposed to one another and has a substantially S-shaped configuration, said batch being enclosed by a container which supports the S-shaped configuration.

By bending the stack of image-receiving material in such manner that it assumes the S-curvature, the stack can be placed in a container of a much smaller format, often a container which has a floor area three times smaller than that of the known flat containers. This means that the container is much easier to handle. In addition, because of the two opposing bends (i.e. bends which are opposed to one another in the longitudinal direction of the stack) in the stack curved into an S-shaped configuration, all the edges of the stack are substantially straight. Each sheet in fact extends through substantially the same path length in the S-curve. The combined consequence of the smaller container and the straight edges is that there is a much smaller risk of damage to the sheets. Other advantages of this method of packing are that the cost price of the containers is relatively low, and a relatively small but straight container can be used. A container of this kind is more environmentally friendly because of the smaller quantity of packing material required. If a straight box is selected as the container, the empty container requires only a small storage capacity, and this is particularly important for the packer of the sheet receiving materials. Also, the shape of the container and the method according to the present invention is much less dependent on the format of the image-receiving material, so that the shape can, for example, be coordinated with the method of transport, particularly the pallets on which the containers have to be loaded.

It is noted that from Japanese patent application JP 03036122 a cassette is known wherein sheets of paper are placed in an S-curve. This cassette however is a feeding cassette for feeding the paper sheets, one-by-one, to a copier and is therefore not suitable for storing and transporting the stack of sheets.

In a preferred embodiment of the present method, the batch is bent in each case, i.e. at each of the bends, over an angle of about 180°. In this embodiment the batch is bent into a "flat" S. In this way, the smallest possible container can be selected. In addition there is the advantage that the batch bent in this preferred manner is fairly compact, and this reduces the risk of damage during transport because the container can be filled relatively evenly.

In another preferred embodiment, the batch is so bent that the S-curvature is substantially symmetrical, i.e. both "legs" of the S have substantially the same dimensions and shape. This has the advantage that a container can be selected which satisfies the same symmetry, particularly a rectangular box. Such boxes have the advantage that they are available and hence can be produced relatively cheaply.

In a further preferred embodiment, the batch is divided into three parts in the longitudinal direction of the S-curvature by the two bends, each of the parts being substantially of the same length. In this embodiment, the batch of image-receiving materials is bent into a symmetrical and compact shape so that a container can be packed very evenly. This results in further reduction of the risk of damage in handling of the packing.

In one preferred embodiment, the batch is provided with a sheeting before being bent. A sheeting of this kind, which can for example be a plastic bag in which the batch is placed before it is bent, has on the one hand the advantage that the outermost sheets do not become dirty in the box, and on the other hand, even more important, it has a reinforcing effect on the bent stack of receiving material. As a result of the presence of the bends, the sheeting is pulled taut over each of the outsides of these bends, so that the S-curvature is supported more satisfactorily. This has the result that the stack bent into an S retains its shape very well in the container so that all the advantages of the invention can be permanently utilised, even if transportation is carried out over considerable distances and/or time, and with considerable mechanical impact.

In one embodiment, the inside of each of the bends is provided with a core having a substantially circular peripheral edge, which core has a length substantially equal to the length of the batch perpendicular to the longitudinal direction of the S-curvature. A core of this kind, for example a cardboard tube, can advantageously be used when bending and the subsequent transport of the image-receiving material avoids permanent "kinking" at the bends. The risk of kinking increases when packing relatively thin stacks of image-receiving material sensitive to kinking, particularly certain plastic film materials such as polyester film. Such cores can be pushed into the bends after the stack has been bent but it is also possible, in order further to reduce the risk of kinking in the image-receiving material, to bend the batch over the cores. In this embodiment, for example, a first core is placed on the stack of image-receiving materials ready for packing, whereafter one of the projecting parts of the stack is bent over the core. A second core can then be placed on the part that has been bent so that it can be bent back over this second core. This results in an S-curvature, in which the two bends are supported by the cores.

As explained above, the present invention can be used particularly advantageously in the packing of a stack of large format receiving materials, such as A0, A1 and the American formats $A0^+$ and $A1^+$. More generally, however, it can be said that the invention can be advantageously applied to the packing of a batch of image-receiving material in which the height of the stack is at least ten times smaller than the length and width of the stack, which is usually equal to the length and the width of each of the sheets in the stack. Such stacks, which have been found in practice to occur particularly in the packing of large format receiving materials, suffer most from the above-mentioned disadvantage of damage, particularly to the sheet edges and corners during transport of the packed stack. Particularly in the case of specialty receiving materials, which are very expensive, often just a few sheets, e.g., 10 to 50 sheets, are packed in a container. This results in considerable transport damage at the edges and particularly at the sheet corners.

The present invention can be used independently of the shape of the container provided, however, advantageously it is so shaped that it sufficiently supports the S-curvature, either by means of its outside walls or by means of extra inside walls or loose auxiliary elements, such as small foam fillers, or the like. The material of the container, for example plastic, filled board, corrugated cardboard, or any other material, or the method in which the container is constructed, for example single-walled or double-walled, with or without reinforced corners, etc., do not form part of the present invention.

The present invention can also be applied if the stack consists of different materials, for example a combination of different paper types and/or transparent film. Use is also possible if the stack comprises sheets of image-receiving material of different formats. In this case the S-curvature has the advantage that the sheets of the smaller format seldom move, if at all, with respect to the larger-format sheets. It is also possible to make a double (or even triple) S-curvature in order to be able to pack a stack of image-receiving material in a container having an even smaller floor area. A double S of this kind also has the advantage that each sheet covers exactly the same path length in the longitudinal direction of the double S so that all the edges are straight.

BRIEF DESCRIPTION OF THE DRAWINGS

The present invention will now be explained with reference to the following drawings, wherein.

DETAILED DESCRIPTION OF THE INVENTION

FIG. 1

Figure 1A:
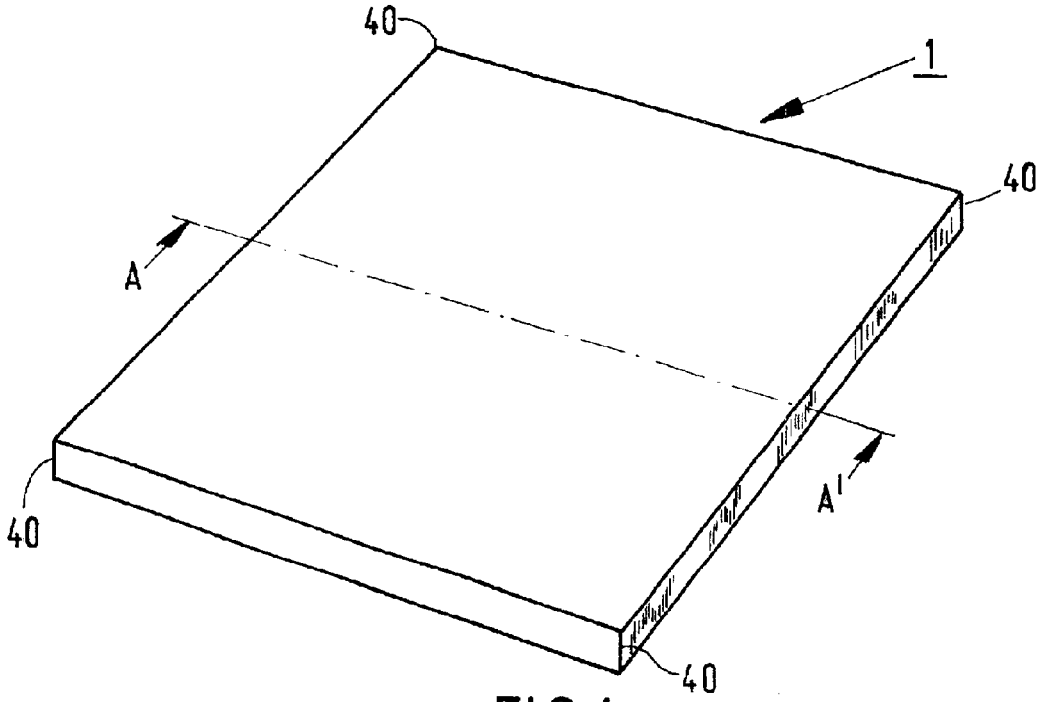
FIG. 1, which is made up of FIGS. 1*a*, 1*b* and 1*c*, shows how a stack of paper is packed in a flat box.
Figure 1B:
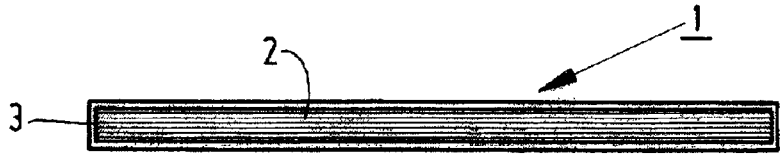
Figure 1C:
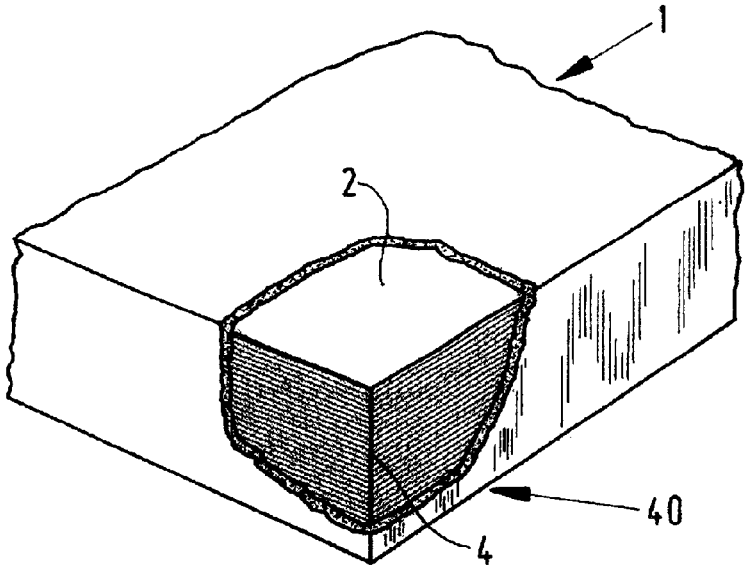

FIG. 1*a* shows a container 1 which is a flat cardboard box provided with four corner points 40. The container contains a stack 2, consisting of large format (A0) 80 g paper in a thickness of 125 sheets of equal size, the stack being visible in a cross-section taken along line A–A', which cross-section is shown in FIG. 1*b*. It will be clear from this Figure that if the container were held obliquely in the cross-sectional plane, the entire stack 2 would press with its edge 3 against the wall of the box. This can result in damage to the sheets at this edge. In FIG. 1*c* corner 40 of the container is shown in cut-away form, i.e., the packed stack of paper 2 is visible. The edge 4 of this stack has been found to be very sensitive to damage while being transported.

FIG. 2

Figure 2A:
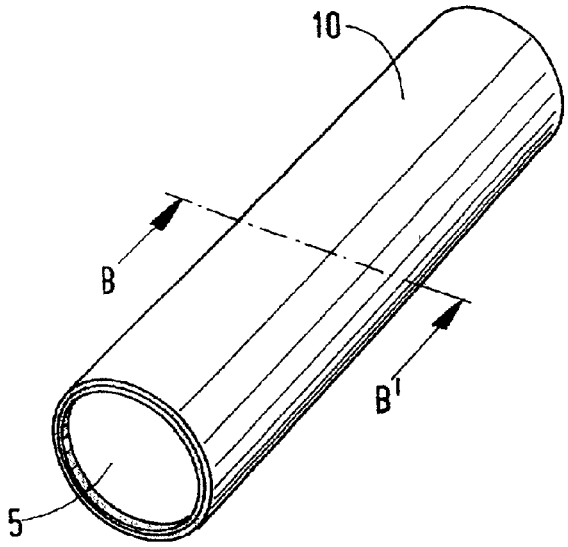
FIG. 2, which is made up of FIGS. 2*a* and 2*b*, shows how a stack of paper is packed in a cardboard tube.
Figure 2B:
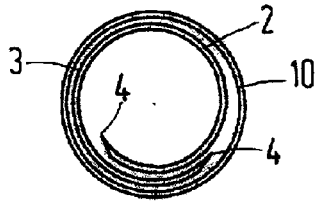

FIG. 2*a* is another example of a stack of paper packed in a container as known in the prior art. In this example, the container 10 is a rigid cardboard tube provided at the ends with plastic lids 5. In a cross-section taken along line B–B' as shown in FIG. 2*b*, the stack of paper 2 is visible. It will be seen that the edge 3 of this stack is well enclosed by the container. This edge will accordingly be substantially undamaged by the mechanical impact on the container. The corner points 4 of the stack are very sensitive to damage while being transported because of their considerable skewing. Drop tests have shown that this method of packing, compared with the packing shown in FIG. 1, does provide a reduction in the damage to the sheets belonging to the stack 2, but there is still a considerable risk of damage.

FIG. 3

Figure 3A:
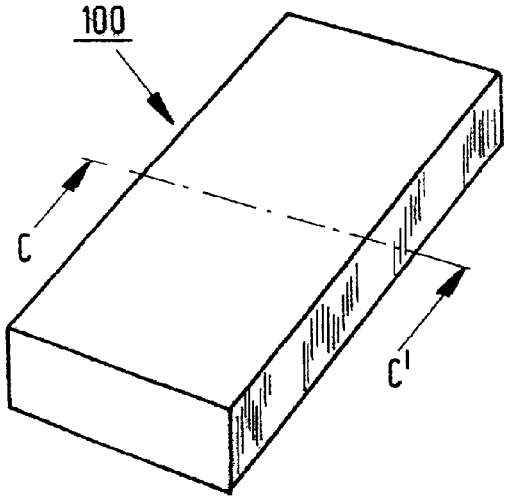
FIG. 3, which is made up of FIGS. 3*a* and 3*b*, shows a stack of paper packed in accordance with the method of the present invention.
Figure 3B:
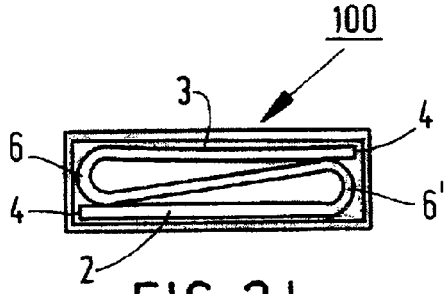

FIG. 3*a* shows a container 100, again a cardboard box in this example, provided with a stack of large-format paper comparable to the stack packed in the container shown in FIGS. 1 and 2. The stack 2 is visible in cross-section as taken along the line C–C' shown in FIG. 3*b*. By bending the paper in accordance with the method of the present invention, this stack is formed into a serpentine configuration, e.g., an S-curve provided with edges 3 and bends 6 and 6'. In this way it is possible to pack the thin but extensive stack in a relatively small container. The stack is substantially straight at the corner points 4 as a result of the double opposed curvature. The shape of the stack remains intact while being transported as a result of the support of the stack at said corner points 4, edges 3 and the bends 6 and 6' in the container 100. The shape of this container gives much less rise to damage to the paper. On the one hand, this is because the container can be handled much more easily so that it will fall or collide less frequently while being transported, while on the other hand the drop tests have shown that if there is nevertheless a hard mechanical impact the stack 2 is much better protected against damage than in the known packing methods. This is probably due to the lateral support of the stack over a relatively large area, namely the edges 4 and the bends 6 and 6' and the fact that in the event of a fall of the container onto one of its corner points the mechanical energy is distributed over a larger area in comparison with the container shown in FIG. 1*a*.

There are various ways in which the method according to the present invention can be performed. It is e.g. possible to firstly bend the stack of sheets into the required S-curve and then place it in the container through a surface opened up (e.g. a side or top surface), whereafter the container is closed. Another example of the method according to the present invention is to use a container in which the entire top, i.e. the side having the largest area, can be opened. The method can then be performed, for example, by starting the bending only after the first part of the stack has been placed in the container, i.e. the s-curve is formed in situ. Particularly for the very large formats, this simplifies the packing of the stack into the container.

FIG. 4

Figure 4:
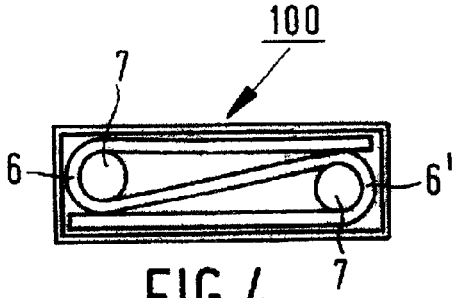
FIG. 4 shows a second embodiment of a packing system according to the present invention.

FIG. 4 shows an alternative embodiment of a stack of image-receiving material packed in accordance with the method of the invention. In this embodiment, the stack 2 is supported at the bends 6 and 6' by cores 7, in this tube cardboard tubes. This packing has the advantage that materials which are very sensitive to kinking which results in permanent crease formed in the sheets, are protected. In one embodiment, the tubes can form part of the container itself.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of packing a batch of image-receiving material for use in a printer, copier or other image forming apparatus into a container suitable for storing and transporting the material, the batch having edges coinciding at corners of the batch, wherein the batch includes a plurality of stacked, substantially identical sheets of the image-receiving material, each sheet having a number of edges, with the corresponding edges of the different sheets substantially coinciding with one another, which comprises:

opening the container, bending the batch over a first bend and bending the batch over a substantially identical second bend opposed to the first bend in such a manner that the batch assumes a substantially S-shaped configuration, and all corners of the batch have right angles independent of the number of sheets in the batch, placing the batch in the container before or after bending, and closing the container, whereby the container then encloses the bent batch such that the S-shaped configuration remains substantially in position for as long as the batch remains in the container.

2. The method according to claim 1, wherein the batch is bent in each case over an angle of approximately 180°.

3. The method according to claim 1, wherein the batch is bent so that the S-configuration is substantially symmetrical.

4. The method according to claim 3, wherein the batch is divided into three parts in the longitudinal direction of the S-configuration by the two bends, wherein each of the parts is substantially of the same length.

5. The method according to claim 1, wherein the batch is provided with a sheeting before being bent.

6. The method according to claim 1, wherein a core is provided inside each of the bends, said core having a substantially circular peripheral edge, wherein the core has a length substantially equal to the length of the batch perpendicular to the longitudinal direction of the S-configuration.

7. The method according to claim 6, wherein the batch is bent over the cores.

8. A batch of image-receiving material for use in a printer, copier or other image forming apparatus which comprises a plurality of stacked, substantially identical sheets of image-receiving material, each sheet having a number of edges with the corresponding edges of the different sheets substantially coinciding with one another such that the edges of the batch correspond at the corners of the batch, said batch being bent to define two substantially identical bends opposed to one another and having a substantially S-shaped configuration, and all corners of the batch have right angles independent of the number of sheets in the batch, said batch being enclosed by a container suitable for storing and transporting said batch, said container supporting the S-shaped configuration.

9. The batch according to claim 8, wherein the sheets are stacked in a stacking direction which jointly defines a stack height, wherein the sheets have a length and width, each being at least ten times as large as the stack height.

10. The method of claim 1, wherein the image-receiving material is paper or transparent plastic.

11. The batch of claim 8, wherein the image-receiving material is paper or transparent plastic.

12. The batch of claim 8, wherein the batch is provided with a sheeting.

13. The batch of claim 8, wherein a core is provided inside each of the bends.

14. The batch of claim 13, wherein the cores have substantially circular peripheral edges, wherein the core has a length substantially equal to the length of the batch perpendicular to the longitudinal direction of the S-configuration.

* * * * *